US010322556B2

(12) United States Patent
Carstens et al.

(10) Patent No.: US 10,322,556 B2
(45) Date of Patent: Jun. 18, 2019

(54) ROTARY TABLET PRESS WITH TABLET OUTLET, TABLET OUTLET FOR SAID ROTARY TABLET PRESS AND METHOD FOR PRODUCING TABLETS ON A TABLET PRESS

(75) Inventors: Jens Carstens, Leverkusen (DE); Uwe Zietmann, Cologne (DE); Mark Strerath, Cologne (DE); Horst Muller, Cologne (DE)

(73) Assignee: IMA KILIAN GMBH & CO. KG, Cologne (DE)

( * ) Notice: Subject to any disclaimer, the term of this patent is extended or adjusted under 35 U.S.C. 154(b) by 1419 days.

(21) Appl. No.: 14/116,733

(22) PCT Filed: May 9, 2012

(86) PCT No.: PCT/IB2012/052317

§ 371 (c)(1),
(2), (4) Date: Jan. 24, 2014

(87) PCT Pub. No.: WO2012/153283

PCT Pub. Date: Nov. 15, 2012

(65) Prior Publication Data

US 2017/0080662 A1 Mar. 23, 2017

(30) Foreign Application Priority Data

May 11, 2011 (DE) ..... 10 2011 050 290

(51) Int. Cl.
*B30B 11/08* (2006.01)
*B30B 11/00* (2006.01)
(Continued)

(52) U.S. Cl.
CPC ..... *B30B 11/08* (2013.01); *B07C 5/18* (2013.01); *B30B 11/005* (2013.01); *B30B 15/32* (2013.01)

(58) Field of Classification Search
None
See application file for complete search history.

(56) References Cited

U.S. PATENT DOCUMENTS 5,971,038 A 10/1999 Fiedler et al.
7,042,231 B2 * 5/2006 Trebbi ..... G01N 22/00 209/571

(Continued)

FOREIGN PATENT DOCUMENTS

CN 2700852 Y 5/2005
DE 2502098 A1 8/1975

(Continued)

OTHER PUBLICATIONS

Espacenet Bibliographic data: JPS61111799 (A), Published May 29, 1986, 1pg.

(Continued)

*Primary Examiner* — Matthew J Daniels
*Assistant Examiner* — Mohammad M Ameen
(74) *Attorney, Agent, or Firm* — Rankin, Hill & Clark LLP

(57) ABSTRACT

A rotary tablet press, having a rotor, which is driveable about a vertical axis of rotation and has a die plate with die bores for producing tablets inside the die bores by means of punch pairs, having at least one filling station, having at least one pressing station, and having at least one tablet outlet for removing the produced tablets out of the rotary tablet press, with which is associated a discharging device, by way of which tablets, in dependence on a control signal, can be supplied as single tablets to a first channel or as a tablet stream to a second channel in the tablet outlet. In order to enable increased production output with improved adherence to the demands on the tablets, a weighing device with a weighing cell is incorporated into the tablet outlet, tablets (Continued)

from the first channel being suppliable to the weighing device by means of a supply channel.

14 Claims, 3 Drawing Sheets

(51) Int. Cl.
*B30B 15/32* (2006.01)
*B07C 5/18* (2006.01)

(56) References Cited

U.S. PATENT DOCUMENTS

| | | | | |
|---|---|---|---|---|
| 7,471,992 | B2 | 12/2008 | Schmidt et al. | |
| 2009/0263532 | A1* | 10/2009 | Haase | B30B 11/08 425/345 |

FOREIGN PATENT DOCUMENTS

| | | | | |
|---|---|---|---|---|
| DE | 102006017196 | A1 | | 10/2004 |
| DE | 102009025779 | A1 | | 11/2010 |
| JP | S61111799 | A | | 5/1986 |
| JP | 2007327962 | A | | 12/2004 |
| JP | 2007-327962 | A | * | 12/2007 |
| WO | 2004/005903 | A1 | | 1/2004 |
| WO | 2008/038070 | A1 | | 4/2008 |
| WO | WO-2008-038070 | A1 | * | 4/2008 |
| WO | WO-2008-038070 | A1 | * | 4/2008 |
| WO | WO-2010-061349 | A2 | * | 6/2010 |

OTHER PUBLICATIONS

Office Action, issued in corresponding European Application No. 12 724 404.4 , dated Nov. 13, 2017, 4 pages.

* cited by examiner

ROTARY TABLET PRESS WITH TABLET OUTLET, TABLET OUTLET FOR SAID ROTARY TABLET PRESS AND METHOD FOR PRODUCING TABLETS ON A TABLET PRESS

The invention relates to a rotary tablet press, having a rotor, which is driveable about a vertical axis of rotation and has a die plate with die bores for producing tablets inside the die bores by means of punch pairs, having at least one filling station for supplying pressing material for the tablets, having at least one pressing station for applying a pressing force onto the punches of the punch pairs, and having at least one tablet outlet for removing the tablets produced by means of the punch out of the rotary tablet press, with which is associated a discharging device, by way of which, in dependence on a control signal, tablets can be supplied as single tablets to a first channel or as a tablet stream to a second channel in the tablet outlet. The invention also relates to a tablet outlet for a rotary tablet press, having at least one first channel and one second channel which, in dependence on a control signal to a discharging device of the rotary tablet press, can be acted upon with tablets as single tablets or as a tablet stream. Finally, the invention also relates to a method for operating a rotary tablet press for producing tablets on the tablet press which has a rotor, which is driveable about a vertical axis of rotation and includes a die plate with die bores, in which tablets are produced by means of punch pairs, the at least one filling station in which pressing material for the tablets is supplied to the die bores, the at least one pressing station in which a pressing force is applied to the punches of the punch pair, the at least one tablet outlet, with which a discharging device is associated, by way of which tablets, in dependence on a control signal, are supplied as single tablets to a first channel or as a tablet stream to a second channel in the tablet outlet, and the one evaluating and control device by way of which a control signal is generated for the discharging device and automatic control of process parameters is effected for the operation of the tablet press and consequently the production of the tablets.

BACKGROUND OF THE INVENTION

A generic rotary tablet press is described, for example, in DE 10 2009 025 779 A1. The generic rotary tablet press is certainly realized for producing multi-layered tablets with tablet cores, however the fundamental components of a corresponding tablet press with filling station, pressing station, control device and tablet outlet can be found in the meantime on almost all the rotary tablet presses available on the market.

In dependence on the number of punch pairs, the number of punch pairs being matched to the number of die bores in the die plate, the rotational speed of the rotor, the size of the tablet, the material used for pressing and the intended purpose of the tablet press, quantities of more than 500,000 tablets per hour can be produced using rotary tablet presses.

In particular in the case of tablets for the pharmaceutical industry, there are increased demands for the tablets to keep to relatively narrow boundaries with regard to their weight and their solidity applied via the pressing force, so that the licensing criteria for the medicines are followed and the active substance used in the tablets can develop in an optimum manner. During regular operation of a tablet press to produce tablets, it is usual to record and log the pressing force within the pressing station in order to deduce from this a first approximation of the supposed weight of the produced tablets. If a deviation of the pressing force is ascertained from a pressing force predefined in the automatic control for the tablet press, e.g. because the die bore was not filled in an optimum manner in the filling station or other irregularities have occurred, a control signal is generated to the discharging device in order to discharge such a tablet into the first channel, which, for example, then forms a bad tablet channel. A corresponding method of operation is described, for example, in DE 10 2005 005 012 A1. If there is no deviation in the pressing force and the rotary tablet press is in production, all the other tablets are normally discharged in a tablet stream as good tablets via the second channel.

It is also known in the prior art to use the discharging device and the first channel (individual channel) for the purpose of removing sample tablets in the current manufacturing process, said sample tablets being stored intermediately in a receiving container and being checked with regard to weight, solidity and size in a testing station which is separate from the tablet press. A solidity test, as a rule, leads to destruction of the tablet, which is why the sample tablets can no longer pass into the distribution. In the pharmaceutical field, sample tablets can also no longer pass into the distribution or the production yield because, in particular in the measuring station and the supply section to the measuring station, the high level of clean room requirements cannot be maintained at justifiable expense. The measuring results of the sample measuring, however, can be used for automatic control of the tablet press, however only with a considerable time delay. Consequently, in a standard manner, the pressing force measured in the pressing station currently forms the control parameter for the tablet press. All of the patents and/or publications referenced above are incorporated by reference into this specification and form part of the specification of this application.

SUMMARY OF THE INVENTION

The invention of this application relates to rotary tablet presses. It is an object of the invention to create a rotary tablet press, a tablet outlet as well as a method for operating a rotary tablet press where the aforementioned disadvantages are avoided and which enables increased production output with improved adherence to the requirements for the tablets.

This object and others are achieved with regard to the rotary tablet press and a tablet outlet in that, according to the invention, a weighing device is incorporated into the tablet outlet, tablets from the first channel being suppliable to said weighing device by means of a supply channel inside the tablet outlet. By incorporating into the tablet outlet a weighing device with preferably a weighing cell or load cell for direct measuring of the tablet weight, it is not only possible to check the tablet produced during the current operation in such a way in very close time with the production sequence with regard to maintaining their weight that a control parameter for controlling the tablet press is able to be deduced herefrom, but by incorporating the weighing device into the tablet outlet it is also possible to supply the samples selected for weighing, in so far as the weighed tablet meets the demand criteria, back again to the tablet stream of good tablets and consequently to the production output. By incorporating the weighing device, consequently, the number of sample tablets on which a real weight test is carried out, is able to be increased by a multiple in relation to the current prior art without this resulting in a reduction in the production output. Through the additional weight check close to the time of manufacture, the quality of the tablet and of the manufacturing process can be improved and the automatic control of the tablet press can be influenced considerably earlier. The incorporation of the weighing device into the tablet outlet presents numerous further advantages which are also explained below.

With regard to a rotary tablet press, it is particularly advantageous when a pressing force measuring apparatus is provided in at least one pressing station and an evaluating and control device is provided, by way of which a control signal for the discharging device can be generated in dependence on the measuring signal of the pressing force measuring apparatus, wherein the discharging device is controllable via the evaluating and control device for singling-out test tablets to be supplied to the weighing device and the punch pair used to press the tablets discharged into the supply channel to the weighing device is storable in the memory of the evaluating and control device. By logging the correlation between punch pair and the obtained weight of a tablet produced by way of said punch pair, considerably more precise automatic control of the tablet press can be achieved, as, where applicable, increased wear on certain punch pairs, or production deviations on certain punch pairs can be recognized in good time and in this respect faulty productions can be avoided in good time.

A tablet outlet according to the invention with an incorporated weighing device can also be attached to existing rotary tablet presses in principle, in so far as they are provided with at least one discharging device which enables the singling-out of tablets. Tablet outlets, as a rule, are provided as detachable parts to be attached to rotary tablet presses, and they are attached, in the majority of cases, in an inclined position on the housing of a rotary tablet press in order to be able to utilize gravitational forces for removing the produced tablets out of the press.

According to an especially advantageous development of a tablet press with an attached tablet outlet or a tablet outlet according to the invention, the first channel, therefore the singling-out channel, has associated therewith adjustable a separator, a supply of tablets out of the first channel to the supply channel being effected only in one position of the separator. By way of the separator, therefore, it can be provided that tablets singled-out into the first channel are only supplied to the weighing device when, for example, the pressing force measurement has not shown that the weight is too low in any case, therefore there is a bad tablet present. Corresponding bad tablets, however, can also be supplied to the weighing device in order to introduce a check or control on the pressing force measuring apparatus, as too low a pressing force does not signify in all cases that a bad tablet is present. Here too, the incorporated weighing device once again offers the possibility of optimizing the entire process sequence. Through the adjustable separator associated with the first channel, therefore, test tablets can be discharged out of the first channel in a targeted manner without each tablet having to be supplied to the weighing device. In dependence on the time required for actuation of the adjustable separator, using the discharging device a bad tablet can also be discharged via the first channel as a result of, for example, the pressing force measurement without a change having to be made to the discharging device or an additional channel having to be created in the tablet outlet. The additional separators also contribute to minimizing the installation space of the tablet outlet and making possible the retention of the dimensions of a tablet outlet.

In a further preferable manner, the tablet outlet has a first outlet channel for good tablets and a second outlet channel for bad tablets, wherein a third outlet channel is preferably provided for sample tablets. The tablet outlet can then have a first channel and a second channel on the entry side, which is controlled by means of the discharging device, and two outlet channels or preferably three outlet channels only on the exit side.

It is particularly advantageous when the tablet outlet has a first plane and at least one second, upper plane, wherein the supply channel to the weighing device is situated in the upper plane. This measure does not only contribute to the minimizing or retention of the width for the tablet outlet, but the higher plane also simplifies the removal of the test tablets, i.e. those tablets which have been weighed in the weighing device, into one of the outlet channels in dependence on the measuring result. The separator can consist, in particular, of a height-adjustable flap and they preferably consist of a flap which is pivotable about a horizontal axis. The actuation of the flap can be effected, in particular, in a pneumatic manner, but also in a mechanical or electromechanical manner. It is obvious that other separators, deflectors, switches or sorting devices could also be used in order to direct a test tablet in a targeted manner out of the first channel into the supply channel to the weighing device.

So that the test tablets weighed in the weighing device with the weighing cell, can be supplied again, where applicable, to the product stream, it is particularly advantageous when the weighing device also has a good outlet for good tablets and a separate bad outlet for bad tablets, and has a suitable control device in order to convey a tablet into the good outlet or into the bad outlet in dependence on the measuring result. It is particularly advantageous when the good outlet of the weighing device opens out into the outlet channel for good tablets.

The advantages according to the invention already exist when one single weighing device is incorporated into the tablet outlet. In order to increase the number of test tablets and consequently the production precision, several weighing devices preferably all with weighing cells for direct measurement of the tablet weight can also be incorporated into the tablet outlet. In order to ensure in the case of several weighing devices that in each case only one test tablet is supplied to each weighing device at any one moment, separators or a sorting device, for example, can be provided for each further weighing device behind the separator associated with the first channel. The different impingement of several weighing devices can, however, also be effected in another manner.

Advantageous for a tablet press or a tablet outlet, in particular, is a weighing device which, inside a framework which can be fastened or is fastened on the tablet outlet, has a weighing chamber with a chamber bottom coupled to a weighing cell, with a first side wall which is closable by means of a movable wall flap, the wall opening of which opens into the good channel, and with a second side wall which can be closed by means of a movable wall flap, the wall opening of which opens into the bad channel. The chamber bottom coupled to the weighing cell can be formed, for example, by a tablet tray, which is coupled directly or via a tappet to a suitable measuring cell. In particular, those weighing cells or load cells which are able to carry out a direct weight measurement in a short time with a high level of reliability and precision even in the case of vibrations are suitable as weight measuring cells.

A weighing device which is suitable for a rotary tablet press or a tablet outlet and which can be of independent inventive significance, is preferably provided with a framework, with a weighing chamber arranged inside the framework with a chamber bottom coupled to a weighing cell for direct weight measuring, with a first side wall and with a second side wall, wherein the framework can be fastened or is fastened to the tablet outlet of a rotary tablet press, wherein a wall opening which is closable by means of a movable wall flap is provided in the first side wall and a wall opening which can be closed by means of a movable wall flap is provided in the second side wall in order to supply tablets after weighing by means of the one wall opening to a bad channel for bad tablets or by means of the other wall opening to a good channel for good tablets. For a compact design and a simple method of operation of a corresponding weighing device on a tablet press or on a tablet outlet, the wall flap can be rotatably mounted close to its top flap end and can be loaded in the closed position by means of the force of gravity. A corresponding weighing device, consequently, then has selfclosing wall flaps which only have to be opened in a selective manner for tablet removal. The removing out of the weighing chamber and the opening of the wall flaps can be effected, in particular, by means of compressed air, which is provided in any case on a corresponding tablet press, for example for the discharging device. To this end, air conduction channels can be realized in the framework and/or in the side walls for pneumatic movement of a tablet and/or pneumatic actuation of the wall flaps by means of a compressed air system.

It is particularly advantageous when the wall flaps have an actuating projection above the pivot bearing, it being possible for said actuating projections to be acted upon with compressed air in opposition to the closing direction thereof via outlet nozzles of the compressed air system. As a short but powerful compressed air pulse has to be applied to eject a tablet out of the weighing chamber, it is particularly advantageous when in the framework a first locking device is provided for the first wall flap and a second locking device is provided for the second wall flap, wherein the compressed air impingement for opening the first wall flap is preferably coupled to the locking device for the second wall flap and the compressed air impingement for opening the second wall flap is coupled to the locking device for the first wall flap. The locking device can consist of control members or the like which are moved in the short term by means of the air blast and prevent an unintended opening of the wall flap which is not required at that particular moment. However, the locking devices can also consist of compressed air nozzles, which are arranged behind the outer surface of the respective wall flap and exert an additional closing force onto that wall flap which is precisely not to be opened during the ejection of the tablet out of one of the wall openings. All the functions of the wall flaps inside the weighing device and also the blowing of the tablets out of the weighing chamber can consequently be effected by means of the same compressed air system. To this end, the weighing chamber can have at least one third side wall opposite the first side wall and one fourth side wall opposite the second side wall, wherein ejection nozzles are arranged in the third and fourth side wall, by way of which ejection nozzles tablets can be supplied in a selectable manner from the chamber bottom to the good channel or to the bad channel, wherein preferably, in each case, one ejection nozzle is coupled to the associated outlet nozzle in the opposite side wall so that, consequently, the tablet is accelerated and the wall flap opened with the same air blast. At the same time, the compressed air impingement can also be used via a further nozzle as a locking device for the respectively other wall flap.

A method for producing a tablet on a rotary tablet press can also be improved in a considerable manner when a weighing device is incorporated into the tablet outlet, to which weighing device tablets from the first channel are supplied via a supply channel, wherein, using a corresponding device, the measuring signal of the weighing cell of the weighing device can be considered as a process parameter in the automatic control of the rotary tablet press. With regard to the method, it is particularly advantageous when the punch pair which was used to produce those tablets the weight of which is measured by means of the weighing device is logged in the evaluating and control device together with the weight recorded by the pressing force sensor during the pressing operation in the pressing station. The assignment of the punch pair not only to the force due to weight measured in the pressing station, but also to the actual weight of the tablet makes it possible to control the method of operation of the rotary tablet press and consequently of the production of the tablets in a considerably more precise manner. The actual weight values and/or the weight values determined via the pressing force can not only be represented graphically over time in order to enable a trend analysis, but by weighing the test tablets in good time a quasi continuous weight check can be achieved, whereas previous tablet presses have made possible at best a statistical check with no assigning of the measured values to the punch pair.

For automatic control it is particularly advantageous when a mean value, which is used for automatic control of the tablet press, is formed from multiple measuring signals of the weighing device. By forming a sliding mean value where only a certain number of last measurements is always used to determine a new mean value, the tablet press itself can be re-adjusted by taking the actual tablet weight into consideration. The method is preferably realized in such a manner that at least one tablet is supplied to the weighing device and measured every two rotations of the motor; it would be even more advantageous when at least one tablet is supplied to the weighing device and measured for each rotation of the rotor. A real weight check, in place of an indirect weight check by means of the pressing force, with, for example, 0.5 to 1 tablet per revolution, results in a quasi continuous weight check in comparison with the prior art. In this connection, the control of the discharging device for test tablets is effected, in particular, in such a manner that tablets which have been produced with different punch pairs are measured in two consecutive measurements.

These and other objects, aspects, features, advantages and developments of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
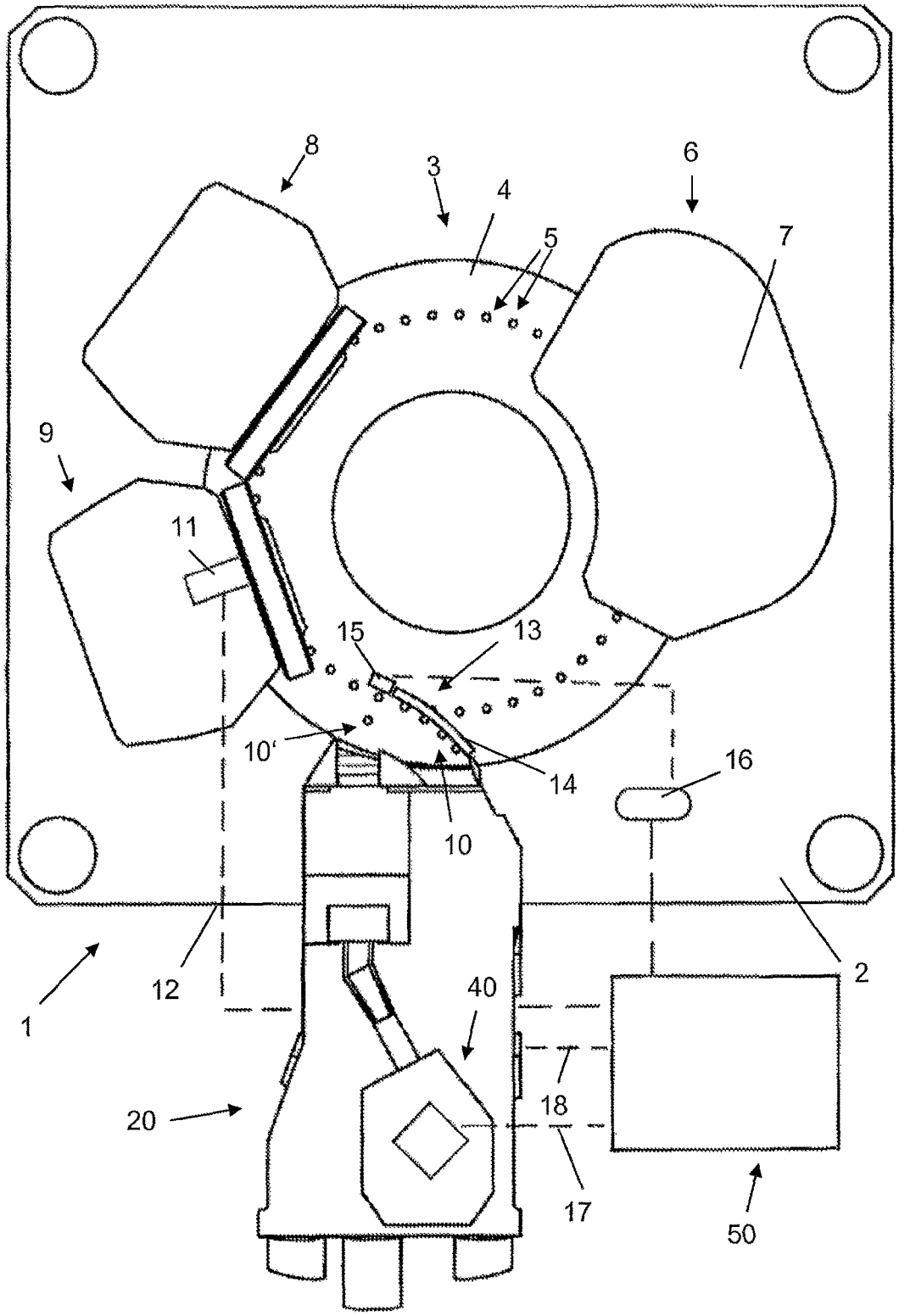
FIG. 1 shows a schematic top view of a rotary tablet press with a tablet outlet according to the invention connected and an evaluating device indicated.

Referring now to the drawings wherein the showings are for the purpose of illustrating preferred and alternative embodiments of the invention only and not for the purpose of limiting the same, FIG. 1 shows a very simplified schematic representation of a rotary tablet press given the overall reference of 1. In a known manner per se, the tablet press 1 has a housing case 2 with fixed, openable access walls and a rotor 3 is rotatably mounted inside the housing 2, of which only the die plate 4 with a plurality of die bores 5 arranged offset around the circumference on a pitch circle is shown in the drawing. Individual tablets, here round tablets, can be produced in large quantities inside the die bores 5, by means of a punch pair (not shown), one of which forms an upper punch and the other a lower punch, which rotate together with the rotor 3 and are raised or lowered by means of guide cams, as is known per se to the expert for rotary tablet presses. The material is supplied into the individual die bores 5 inside a filling station 6, shown in a schematic manner by means of a filling shoe 7, and once the die bores 5 have been filled and, where applicable, metering has taken place inside a metering device (not shown), the material is compressed by means of a first pressing station 8, in which a preliminary pressure is applied, and in a second pressing station 9, in which the main pressure is applied. In the exemplary embodiment shown, only the pressing station 9 has associated therewith a schematically indicated pressing force measuring apparatus 11, by way of which the pressing pressure of the associated punch pair is measured in the pressing station 9 and can be supplied to a control and evaluating device 50 as a measuring signal via a suitable signal line 12.

The rotary tablet press 1, in addition, is provided in a manner known per se with a discharging device 13, which, on the one hand, has a removal rail 14 in order to be able to supply the tablets 10 produced inside the die bores 5 as a tablet stream, as shown, to a multiplechannel tablet outlet 20, and which, on the other hand, has a preferably pneumatically operated singling-out apparatus 15 as a component of the discharging device 13, by means of which individual tablets, like the sample or test tablets 10' shown schematically in FIG. 1, can be supplied as single tablets to another channel of the tablet outlet 20. The control of the discharging device 13 or of the singling-out device 15 inside the discharging device 13 is effected by means of a control signal from the evaluating and control device 50 and an associated control module 16 for the compressed air supply to the singling-out device 15. A rotary tablet press 1 with the aforementioned design is sufficiently known to the relevant expert, which is why no detailed description is effected here.

In the case of the rotary tablet press 1 according to the invention, a weighing device 40 with a suitable measuring cell for direct weighing a tablet is incorporated into the tablet outlet 20, and the measuring signal of the weighing cell of the weighing device 40 can be supplied via a further signal line 17 to the evaluating and control device 50. Separators, sorting devices and/or ejection nozzles can be actuated via the signal line 18 inside the tablet outlet 20 and/or the weighing device 40 by means of the evaluating and control device 50, as will be explained below with reference to FIGS. 2 to 5.

Figure 2:
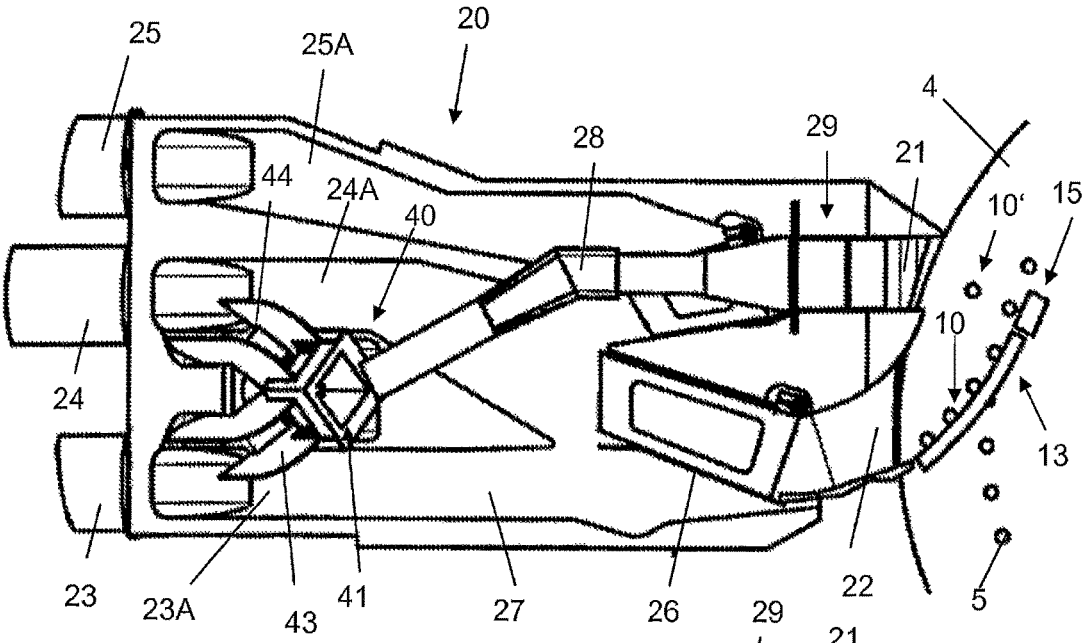
FIG. 2 shows a top view of a detail of the tablet outlet with the cover removed.

FIG. 2 shows the tablet outlet 20 with the cover removed. A cover is necessary in particular when a tablet press is used to produce pharmaceutical tablets where there are relatively strict requirements and contaminants produced by the ambient air and other influences have to be avoided. On its entry side, which in the mounted state of the tablet outlet 20 faces the discharging device 13, the tablet outlet 20 has a first channel 21 for those tablets 10' which have been sorted out from the produced tablets 10 as single tablets by means of the singling-out device 15, and it has a second channel 22, by means of which tablets 10 can be guided out of the tablet press as a tablet stream. In normal operation, the individual tablets 10 would normally lie edge to edge in the product stream.

On the exit side, the tablet outlet 20 in the exemplary embodiment shown has a first outlet channel 23 for good tablets, a second outlet channel 24 arranged here in the center for bad tablets and a third outlet channel 25, by means of which tablets singled-out in the first channel 21 can be selectively supplied to an external sample test. A sorting flap 26, which in the representation according to FIG. 2, would still supply the tablet stream of tablets 10 to the bad channel 24 is associated with the tablet outlet 20 inside the second channel 22; during production, in particular when the tablet press has completely started-up, the sorting flap 26 is pivoted in such a manner that its exit end opens out into the good channel 23. To this end, the sorting flap 26 can be activated, for example, in a mechanical, electro-mechanical or pneumatic manner. In the state attached to a tablet press 1, the bottom 27 of the tablet outlet 20 normally lies in an inclined manner and forms a chute, so that the individual tablets slide into the outlet channels 23, 24 or 25 through the force of gravity.

The first channel 21, into which the tablets 10' are fed by means of the singling-out device 15, has associated therewith a supply channel 28, by means of which the singled-out tablets are supplied to the weighing machine 40. It can be seen relatively well from FIGS. 2 to 4 that the supply channel 28 is located at a higher level than the bottom plate 27 of the tablet outlet 20 and, in particular, is located at a higher level than the associated line channels 23A, 24A, 25A for the individual tablet outlets 23, 24, 25 inside the tablet outlet 20, which are defined below by the bottom plate 27. The supply channel 28 and the weighing device 40, therefore, form inside the tablet outlet 20 a second upper plane, which is located at a higher level than the bottom plane with the channels 21, 22 or the line channels 23A, 24A and 25A, which is defined by the bottom plate 27. Whether or not a tablet 10', which is discharged into the first channel 21 in a singled-out manner by means of the singling-out device 15, is supplied to the supply channel 28 or the sample channel 25, is preset by means of the evaluating and control device (50, FIG. 1), which, for this purpose, can control adjustable separator 29, which are associated with the first channel 21 on the entry side. In the exemplary embodiment shown, the separator 29 essentially consist of a height-adjustable pivot flap 30, which is rotatably mounted on one side and which can be seen in a particularly clear manner in FIG. 4 in its upper pivot position in which nothing is supplied to the supply channel 28. The actuation of the flap 30 can be effected, in particular, in a pneumatic manner by means of a pneumatic drive 31, which is attached to the tablet outlet 20. The suspension of the pivot flap 30, which is pivotable about a horizontal pivot axis, is effected by means of two bearing blocks 32, which are fastened on both sides of the pivot flap 30 approximately at the level of the bottom of the upper second plane on the tablet outlet 20 or on a tablet outlet housing. If the flap 30 is in the bottom position (not shown), the tablet 10' is moved by means of the ejection pulse of the discharging device 15 along the ramp formed by way of the pivot flap 30 upwards into the higher plane and then passes by means of the tubular supply channel 28 into a weighing chamber 41 of the weighing device 40. The weighing chamber 41, in this case, has a rectangular design with four side walls and it is open upwards such that the tablets can be poured from above into the weighing chamber 41. If a tablet to be weighed is located inside the weighing chamber 41, a measurement is effected and the measuring signal of the weight measurement is sent back to the evaluation and control device and is logged there. At the same time, the punch pair, by way of which the tablets, singled-out by means of the discharging device 15 and measured in the weighing chamber 41 of the weighing device 40, have been produced, is logged in the evaluating and control device 50. Precise association is only possible when a tablet, singled-out into the first channel 21 of the tablet outlet 20, is supplied to the weighing device 40, wherein, in addition, in dependence on the rotational speed of the rotor, it can also be necessary for a certain number of tablets to have to be supplied to the second channel 22 before and after the singled-out tablets, as otherwise the time available would not be enough to move the separator 29 into the position in which the tablet is supplied as a single tablet to the supply channel 28.

Figure 3:
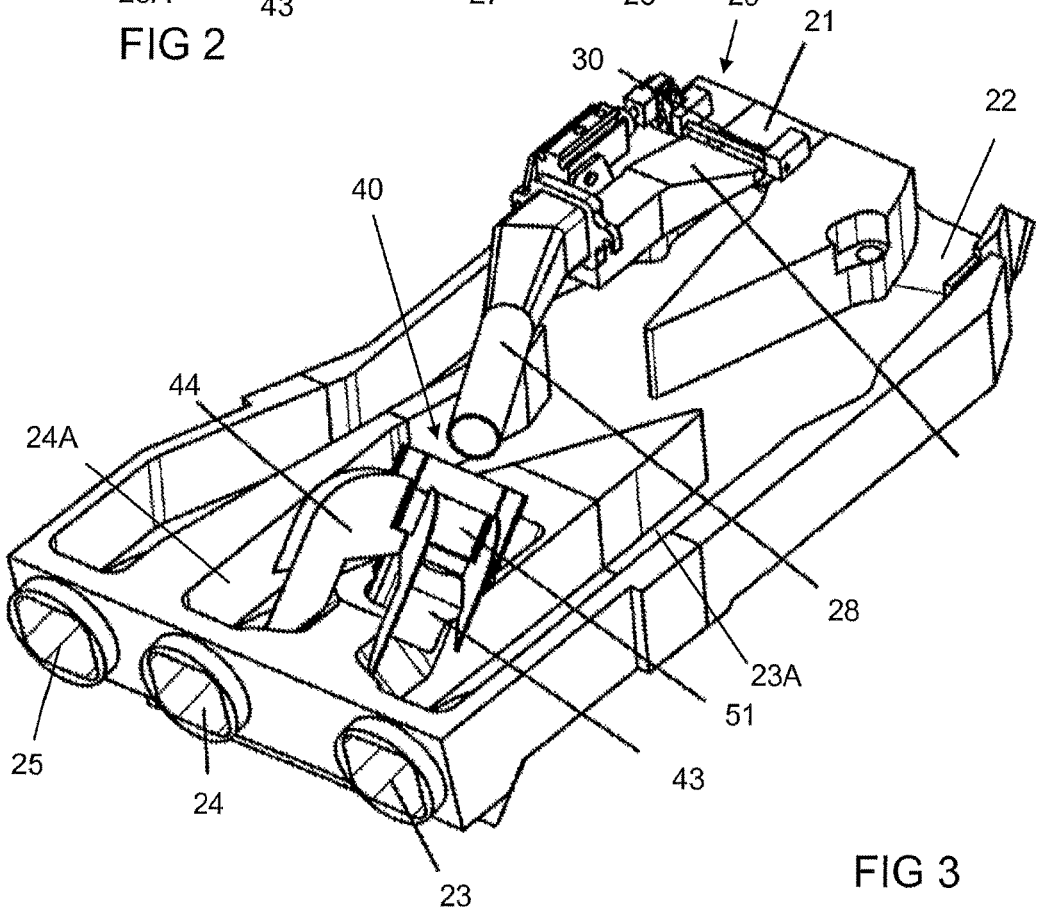
FIG. 3 shows a perspective view of a tablet outlet according to the invention.
Figure 4:
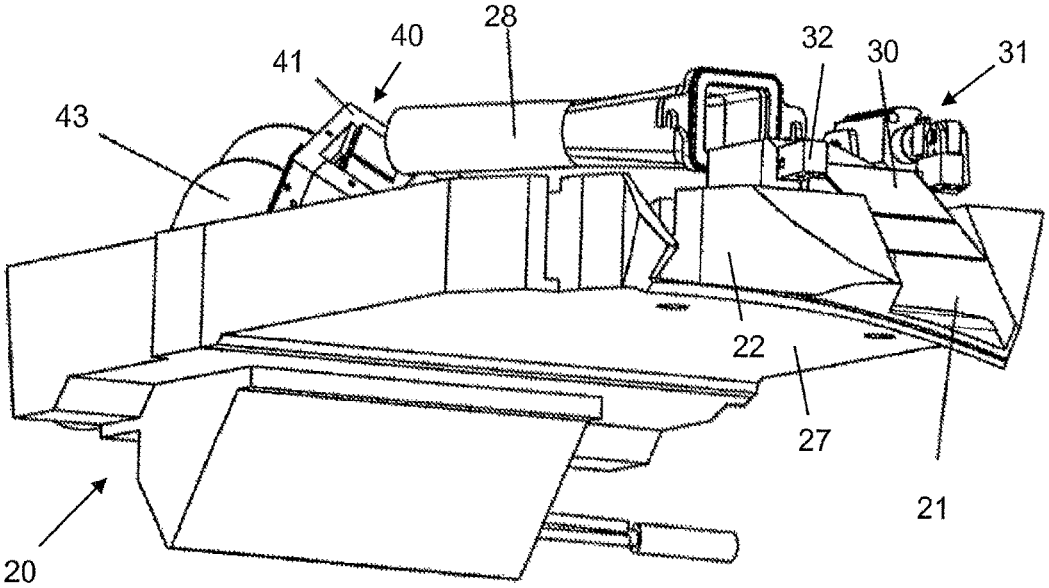
FIG. 4 shows a perspective view of the tablet outlet from FIG. 3, when looking onto the entry side.

As can be seen particularly clearly in FIGS. 2 and 3, tablets can be supplied from the weighing chamber 41 in a selective manner by means of a good outlet 43, which is formed, for example, by a curved chute, to the tablet outlet 23 for good tablets or by means of a bad outlet 44, which is once again formed by a curved chute, to the tablet outlet 24 for bad tablets without leaving the tablet outlet 20, that is to say still inside the tablet outlet 20. As a rule, the tablets supplied to the weighing device 40 are those where the pressing force measuring apparatus has, in any case, determined a value that lies within the tolerance limits for the pressing force, and in such a case the measurement inside the weighing device 40 forms a control measurement for the precise weight determination and optimization of the process parameters for the tablet press, which is why, when the overall weight is maintained, the tablet can be supplied without any problem to the good stream inside the tablet outlet 23 for good tablets. The tablet supplied by means of the supply 28 to the weighing device 40 for weighing, however, can also be such a tablet 10' which has been ejected by means of the discharging device 15 because the pressing force was outside the tolerance range. The weight of the tablet can be checked via the weighing device 40, and if, in spite of the error message on account of the pressing force measuring sensor, the weight lies within a predetermined tolerance range, the decision can be made with regard to discharging out of the weighing device 40 to supply the tablet, nonetheless, by means of the good channel 43 to the tablet outlet 23 for good tablets. If the weight is confirmed to be too low, the discharging out of the weighing device 40 is effected into the bad channel 44 and subsequently into the outlet 24 for bad tablets. The check is still effected inside the tablet outlet 20 as close as possible to the tablet press, and as for the tablet outlet 20 clean room conditions, as in the press room, also have to be maintained for pharmaceutical products, a tablet measured with regard to its weight can still be supplied to the product stream for the production output.

Figure 5:
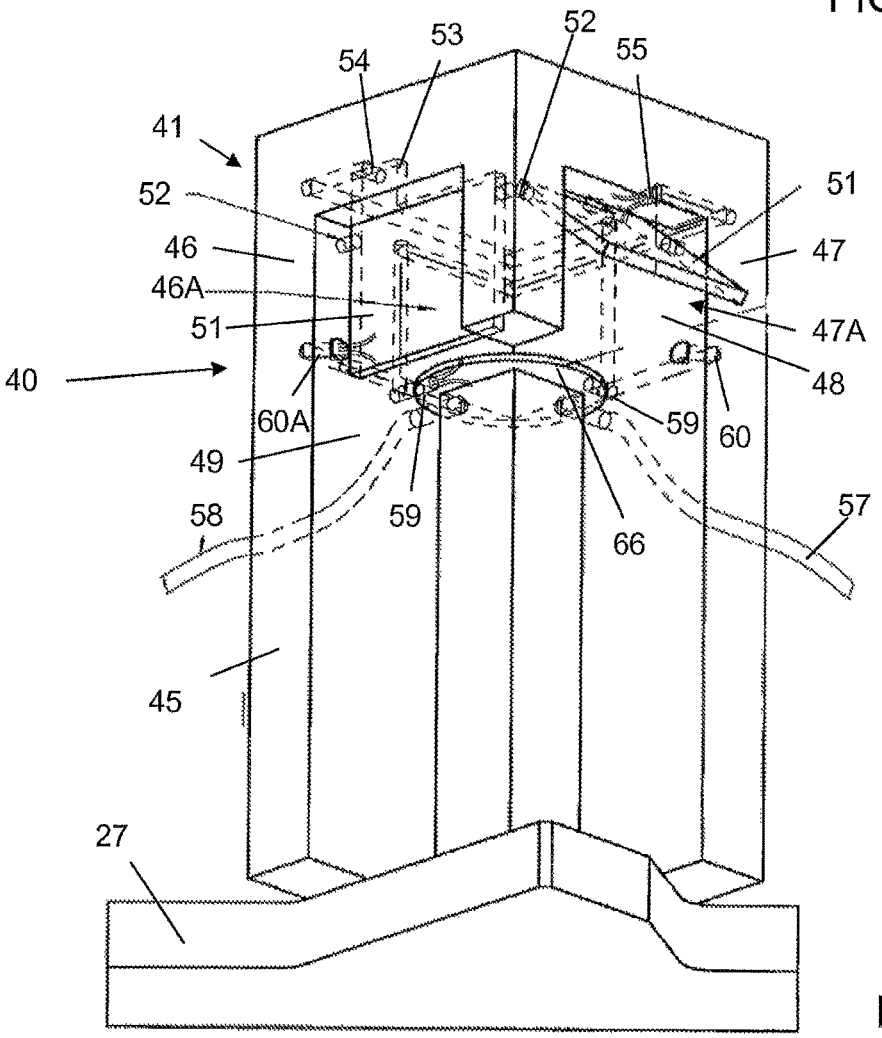
FIG. 5 shows a schematic representation of the design of a metering device for the tablet outlet according to the invention.

FIG. 5 now shows a particularly advantageous design of a weighing device 40. The weighing device 40 has a framework 45, by way of which it is fastened, for example, to the bottom 27 of the tablet outlet 20 between the line channels 23A, 24A in such a manner that the actual weighing chamber 41 is located higher than the bottom plate 27 at the necessary spacing. The bottom of the weighing chamber 41 consists of, in this case, a plate-shaped tablet tray 66, which is coupled in a suitable manner via a plunger or directly to a weighing cell (not shown) which determines the weight of a tablet placed on the tablet tray 46 and forwards it to the evaluating and control device (50, FIG. 1). In the case of a rectangular or, in this case, quadratic design of the weighing chamber 41, said chamber has a first side wall 46, a second wall 47, a third side wall 48 which is opposite the first side wall 46 and a fourth side wall 48 which is opposite the second side wall 47. A first wall opening 46A is provided in the first side wall 46 and a second wall opening 47A is provided in the second side wall 47, by means of which measured tablets can be supplied either to the good outlet or the bad outlet. Both wall openings 46A, 47A are in each case closed by way of a separate wall flap 51, said wall flaps essentially being designed in an identical manner, FIG. 5 showing the wall flap 51 for the wall opening 46A in the closed position and that for the wall opening 47A being shown in the open position. Both wall flaps 51 are in each case mounted close to their upper end so as to be rotatable about an axis of rotation 52, a projection 53 being realized as an actuating projection on the wall flap 51 above the axis of rotation 52. The wall flaps 51 open outwards and the framework 45 is arranged together with the bearing axes 52 for the wall flaps 51 in such a manner that the wall flaps 51 remain in their closed position by means of the force of gravity.

In the case of the weighing device 40 shown, the opening of the wall flaps 51, and also the ejection of a tablet measured beforehand with regard to its weight, is effected by means of compressed air, which is distributed by means of a schematically indicated ventilation system in the framework 45, in particular in the side walls 46 to 49. The compressed air system with the ventilation channels in the framework 45 is constructed in such a manner that there are two separately controllable line branches, the one line branch including an outlet nozzle 54 which is associated with the actuating projection 53 on the ventilation flap 51 for the wall opening 46A, whilst the other line branch has an outlet nozzle 54 for the other wall flap 51 on the wall opening 47A. The control of the nozzle 54 is effected, for example, by means of the hose 57 and the control of the nozzle 55 is effected by means of the hose 58. In FIG. 5, the hose 58 is acted upon momentarily with compressed air, which is why the wall flap 51 in the side wall 47 is open. At the same time as the air exits at the nozzle 55, an ejection nozzle 59A is actuated, said ejection nozzle being realized in the second side wall 49 and being located opposite the wall opening 47A in such a manner that a tablet positioned on the tablet tray 66 is expelled through the wall opening 47A and, for example, is ejected into the good channel. At the same time, in order to make sure in a reliable manner that the wall flap 51 for the wall opening 46A does not open as a result of the compressed air differentials, the ventilation system is connected by means of a further channel inside the fourth side wall 49 to an outlet nozzle 60A which is situated on the outer surface or rear surface of the flap 51 for the wall opening 46A and prevents it being possible for the wall flap 51 of the wall opening 46A to be opened unintentionally through overpressure in the weighing chamber 41. A corresponding ventilation system is also connected in a mirror-symmetrical manner to the hose 57 such that whenever a tablet is to be transferred, for example, into the bad channel, the wall flap 51 for the wall opening 47A remains in its closed position and the wall flap 51 for the wall opening 46A, at the same time as the ejection nozzle 59 is actuated, is opened by means of the nozzle 54, whilst the nozzle 60 serves as a locking device for the other wall flap 51.

Tablets can be supplied to the weighing device 40 at certain time intervals, the minimum interval depending on the actuating times for the separator and the rotational speed of the rotor. A considerable improvement in the production process for tablets in particular produced from high-value initial materials can be achieved when at least one tablet is supplied to the weighing device per revolution or per two revolutions and, where applicable, a control parameter for the automatic control of the tablet press is derived from the measured weight. Through additional discharging devices, additional tablet outlets or additional weighing devices with associated separators, the number of tablets tested in normal operation, therefore continuously, can be increased and after successful measurement adhering to all the tolerance limits, can be once again supplied to the production output of good tablets. In place of the afore-described pneumatic actuation of the separators and flaps, it could also be possible for it to be effected in a mechanical or electro-mechanical manner; it could also be possible to combine pneumatic and mechanical actuation, particular advantages being provided, however, through entirely pneumatic control of the locking device, of the opening devices and of the ejection device out of the weighing device. As it is possible to store the weight actually present at the tablet together with the punch numbers of the punch pair and the measured pressing force, it is also possible to ascertain errors made here at individual punch pairs. It is true that a control parameter could be derived from each individual value, greater precision can be achieved, however, by mean values being formed from a certain number of individual measurements, for example from ten individual measurements, as required in the pharmaceutical industry, before a control parameter for the tablet press is derived. Automatically taring the weighing device at certain intervals in time can prevent the weighing device itself forming a source of error.

To the expert, numerous modifications which are to fall within the range of protection of the attached claims, proceed from the preceding description. In particular, the invention is not restricted to the exemplified embodiment shown. The exemplary embodiment explains the invention by way of a tablet press which creates a tablet when revolving about 360°. For shorter production time, two tablet outlets, two or four pressing stations and in a corresponding manner two filling stations could be arranged on the tablet press. A sample sequence can also be omitted.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A rotary tablet press, having a rotor, which is driveable about a vertical axis of rotation and has a die plate with die bores for producing associated tablets inside the die bores by way of punch pairs, having at least one filling station for supplying pressing material for the associated tablets, having at least one pressing station for applying a pressing force onto the punches of the punch pairs, the rotary tablet press producing a tablet stream of associated tablets, and the rotary tablet press having at least one tablet outlet for removing the tablet stream of associated tablets out of the rotary tablet press, the at least one tablet outlet having a first channel and a second channel, the at least one tablet outlet further including a first outlet channel for associated good tablets and a second outlet channel for associated bad tablets, the rotary tablet press further including a discharging device, by way of which, in dependence on a control signal, selectively directs a single test tablet from any tablet within the tablet stream to the first channel and the tablet stream being directed into to the second channel, the at least one tablet outlet further including a weighing device with a weighing cell for fully weighing a tablet weight of the associated test tablets and a supply channel that is separate from the second channel for the tablet stream and is for supplying the associated test tablets from the first channel to the weighing device that is incorporated with the supply channel and the at least one tablet outlet, the weighing cell being separate from the second channel, the weighing device having a good outlet for the associated good tablets of the associated test tablets and a separate bad outlet for the associated bad tablets of the associated test tablets, the good outlet of the weighing device being selectively operably openable into the first outlet channel to allow the associated good tablets of the associated test tablets to re-join the tablet stream, the bad outlet of the weighing device being selectively operably openable into the second outlet channel for the associated bad tablets of the single test tablets.

2. The tablet press according to claim 1, further including a pressing force measuring apparatus in the pressing station and an evaluating and control device, by way of which a control signal for the discharging device is generatable in dependence on the measuring signal of the pressing force measuring apparatus, wherein the discharging device is controllable via the evaluating and control device for singling-out associated test tablets to be supplied to the weighing device and the punch pairs used to press the associated tablets discharged into the supply channel to the weighing device is storable in the memory of the evaluating and control device, the weighing device returning the singled-out associated test tablets to the tablet stream by way of the good outlet if the singled-out associated test tablets meet designated weight requirements.

3. The tablet press according to claim 1, wherein an adjustable separator is assigned to the first channel, wherein associated tablets in the first channel are only supplied to the supply channel in one position of the separator.

4. The tablet press according to claim 1, wherein the at least one tablet outlet further includes a third outlet channel for output of associated sample tablets for manual testing.

5. The tablet press according to claim 1, wherein the tablet outlet has a first plane and at least one second, upper plane, wherein the supply channel to the weighing device is situated in the upper plane.

6. The tablet press according to claim 3, wherein the separator is formed by a height-adjustable flap.

7. The tablet press according to claim 2, wherein the single test tablet is randomly selected from the tablet stream and the evaluating and control device utilizing the tablet weight to automatically optimize the performance of the tablet press.

8. The tablet press according to claim 1, wherein the at least one tablet outlet lies in an inclined manner and the associate tablets slide into the first and second outlet channels through the force of gravity.

9. The tablet press according to claim 1, wherein several weighing devices are incorporated into the at least one tablet outlet, separators or a sorting device are provided for each of the several weighing device.

10. A rotary tablet press, having a rotor, which is driveable about a vertical axis of rotation and has a die plate with die bores for producing associated tablets inside the die bores by way of punch pairs, having at least one filling station for supplying pressing material for the associated tablets, having at least one pressing station for applying a pressing force onto the punches of the punch pairs, and having at least one tablet outlet for removing associated produced tablets out of the rotary tablet press, with which tablet outlet is associated a discharging device, by way of which, in dependence on a control signal, associated tablets being suppliable as single tablets to a first channel or as a tablet stream to a second channel in the tablet outlet, and a weighing device with a weighing cell for weighing the weight of the associated tablets being suppliable from the first channel by way of a supply channel to the weighing device is incorporated into the tablet outlet, the weighing device, inside a framework fastened to the tablet outlet, has a weighing chamber with a chamber bottom coupled to the weighing cell, with a first side wall which is closable by way of a movable wall flap, the wall opening of which opens into the good channel, and with a second side wall which is closed by way of a movable wall flap, the wall opening of which opens into the bad channel.

11. A rotary tablet press, having a rotor, which is driveable about a vertical axis of rotation and has a die plate with die bores for producing associated tablets inside the die bores by way of punch pairs, having at least one filling station for supplying pressing material for the associated tablets, having at least one pressing station for applying a pressing force onto the punches of the punch pairs, and having a tablet outlet for removing associated produced tablets out of the rotary tablet press from a tablet stream produced by the rotary tablet press, the rotary tablet press further including a discharging device, by way of which, in dependence on a control signal, associated tablets being suppliable as single test tablets from any tablet in the tablet stream to a first channel or as the tablet stream to a second channel in the tablet outlet, the tablet outlet further including a weighing device with a weighing cell for fully weighing a tablet weight of the single test tablets and a supply channel that is separate from the second channel for the tablet stream and is for supplying the associate test tablet from the first channel to the weighing device wherein the weighing device is incorporated with the supply channel and the tablet outlet, the weighing cell being separate from the second channel and the weight device having a good outlet for associated good tablets and a separate bad outlet for associated bad tablets, the good outlet of the weighing device being selectively openable into the second channel and the tablet stream wherein associated good tablets of the single test tablets can be returned to the tablet stream, the bad outlet of the weighing device being selectively openable into an outlet channel for associated bad tablets of the single test tablets.

12. The tablet press according to claim 11, wherein the tablet outlet has a testing outlet channel for associated sample tablets for manual testing.

13. The tablet press according to claim 11, wherein the good outlet of the weighing device is selectively openable into an outlet portion of the second channel.

14. The tablet press according to claim 11, wherein the tablet outlet lies in an inclined manner and the associate tablets slide toward first and second outlet channels through the force of gravity.

* * * * *